United States Patent [19]

Webb

[11] Patent Number: 4,691,607

[45] Date of Patent: Sep. 8, 1987

[54] RADIAL ARM SAW POSITIONER

[76] Inventor: Floyd A. Webb, 611 E. Sheridan, Olathe, Kans. 66061

[21] Appl. No.: 849,168

[22] Filed: Apr. 7, 1986

[51] Int. Cl.[4] ..... B27B 5/20; B27B 27/10

[52] U.S. Cl. ..... 83/468; 269/303; 269/315; 269/319

[58] Field of Search ..... 83/468, 467; 269/303, 269/315, 319

[56] References Cited

U.S. PATENT DOCUMENTS

| | | | |
|---|---|---|---|
| 305,563 | 9/1884 | Baer | 83/468 |
| 1,459,873 | 6/1923 | Blackburn | 83/468 X |
| 2,485,274 | 10/1949 | Garrett | 83/468 |
| 2,619,134 | 11/1952 | West | 83/468 |
| 2,747,625 | 5/1956 | Small | 83/468 |
| 2,892,474 | 6/1959 | Hiebert | 83/468 |
| 3,348,591 | 10/1967 | Carrasco | 83/468 |
| 3,807,269 | 4/1974 | Mertes | 83/468 |
| 4,111,088 | 9/1978 | Ziegelmeyer | 83/468 X |
| 4,256,000 | 3/1981 | Seidel | 83/468 |
| 4,412,468 | 11/1983 | Bucy | 83/468 |

*Primary Examiner*—Donald R. Schran

*Attorney, Agent, or Firm*—Litman, Day & McMahon

[57] ABSTRACT

A board positioner operationally cooperates with a radial arm saw with a workpiece fence to measure a board to be cut by the saw. The positioner comprises a support structure, a slide bar supported by the structure and a slide mounted on the slide bar. The slide is selectively rotatable with respect to the bar and infinitely positionable therealong. The slide includes a bridge which allows the slide to arc the fence when in operational position to assist an operator in cutting a board from a workpiece.

4 Claims, 4 Drawing Figures

Fig.1.
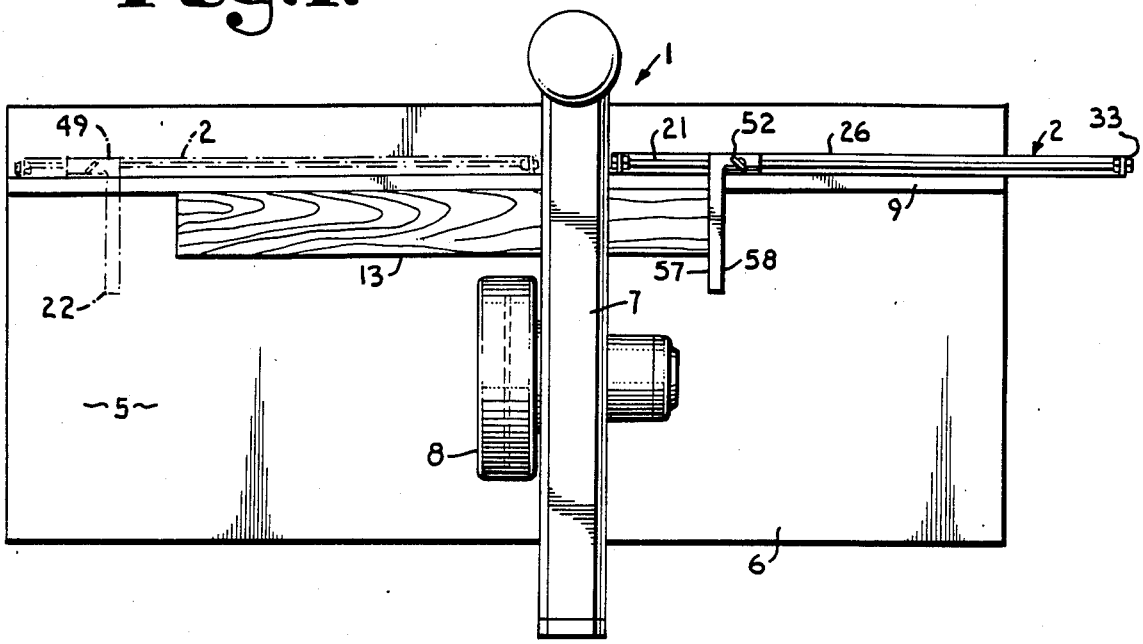
Fig.2.
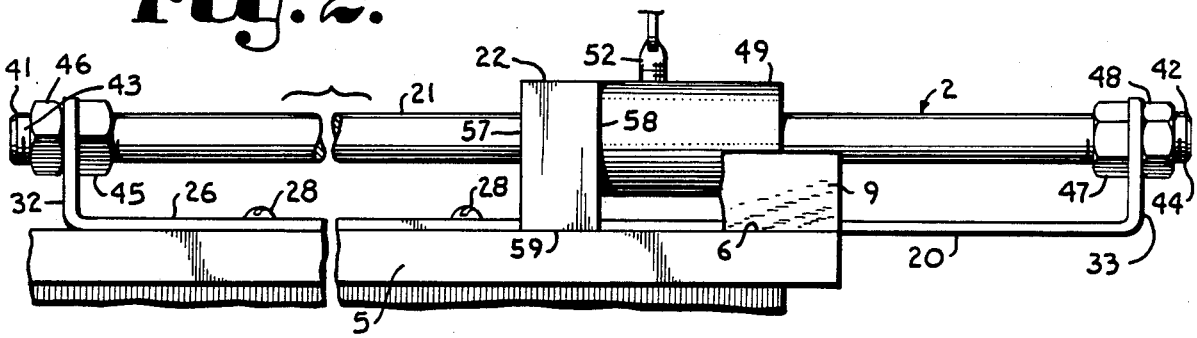
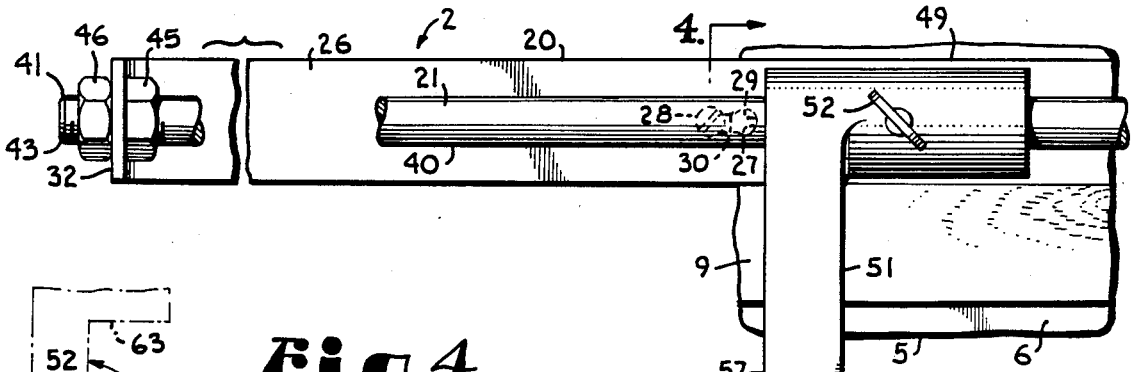
Fig.3.
Fig.4.
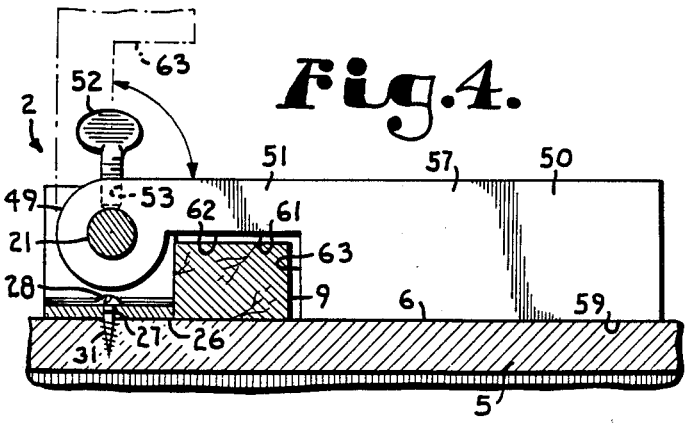

RADIAL ARM SAW POSITIONER

BACKGROUND OF THE INVENTION

The present invention is directed to a positioner for a radial arm saw and, in particular, to a positioner which allows quick and simple positioning of numerous workpieces such that each can be cut to a predetermined length which is infinitely variable.

Radial arm saws have always been quite popular with professional carpenters and woodworkers as well as hobbiests who may use the saws infrequently. The popularity of the radial arm saw may rest in its versatility and ease of use. Virtually anyone who uses a radial arm saw with any frequency has encountered the problem of quickly and easily measuring a number of boards to a common predetermined length and thereafter cutting the boards on the saw. Some users nail a block to the saw table to provide them with a guide to use in sawing the boards.

For those who use radial arm saws to cut boards to a predetermined length on a frequent basis, gauges or guides have been developed to ease this process. Unfortunately, many of the previously devised guides are quite expensive, not infinitely adjustable to various lengths, cannot be easily retrofitted to different saws, are not easily moved out of the way when not in use, and/or are difficult to use.

As an example of prior art, a complex lumber measuring device is shown in the Small U.S. Pat. No. 2,747,625. This device functions well to measure a particular cutoff length, but is expensive and designed more for lumber yards or high volume commercial shops and would not be affordable to a typical owner of a radial arm saw.

A number of prior art devices utilize the concept of a slide which is lockable to a fence of the radial arm saw (that is, the upright along which a board is positioned prior to cutting). Such devices are shown in the Siedel U.S. Pat. No. 4,256,000 and Ziegelmeyer U.S. Pat. No. 4,111,088. While such devices often function adequately, they must be removed from the rail in order to allow the saw to be placed in a mode where boards of varying lengths can be easily cut.

One prior art device has been able to partially overcome the problem of quickly moving the positioner out of the way and is shown in the Bucy U.S. Pat. No. 4,412,468. In Bucy, a fixed slide guide is positioned along the back of the fence with a slide that can be rotated to extend forward of the fence. The fence is channelled to allow the guide to fall into a selected channel. While the slide in the Bucy device can be moved to various locations and can be moved out of the path of boards to be cut when different lengths are desired, the fixed spacings between channels prevent easy positioning of the slide in an infinitely large variety of positions and prevent simple sliding of the slide in a down position to a new location.

OBJECTS OF THE INVENTION

Therefore the objects of the present invention are: to provide a board positioner for utilization in conjunction with a radial arm saw which comprises a slide that is easily moved from a working position wherein boards may be cut to a selected length to a nonworking position wherein the slide is not in the way of boards to be cut to varying lengths; to provide such a positioner which allows an infinite adjustment of the location of the slide relative to a saw blade so that an infinite variety of lengths are available from which to choose to cut a number of boards; to provide such a positioner with a slide that does not restrictively engage the saw fence in any position and which can be slid along the work surface of the saw to a new position; to provide such a positioner which is easily retrofitted to an existing radial arm saw; to provide a positioner which can be easily utilized on either side of the saw blade; and to provide such a positioner which is easy to manufacture, simple to use, inexpensive to purchase and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a top plan view of a radial arm saw showing a positioner in accordance with the present invention shown at a first location thereon and the positioner shown in phantom lines at a second alternative location thereon.

FIG. 2 is an enlarged and fragmentary side elevational view of the saw and positioner with portions thereof broken away to show detail.

FIG. 3 is an enlarged and fragmentary top plan view of the saw and positioner with portions broken away to show detail thereof.

FIG. 4 is an enlarged and fragmentary cross-sectional view of the saw and positioner taken along line 4—4 of FIG. 3.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Shown in FIGS. 1 through 4 is a radial arm saw 1 in combination with a board positioner 2, in accordance with the present invention.

Although a particular radial arm saw 1 is shown in the drawings, it is foreseen that the present invention can be utilized in conjunction with many different types of this kind of saw, whether the saw is designed for commercial use or for use by an amateur carpenter.

The saw 1 includes a work table 5 with a generally horizontally aligned work surface 6, a swingable arm 7 which is selectively movable about a normally vertical axis, a motorized saw mechanism with a cutting blade 8 and a workpiece fence 9. The fence 9 is positioned on the rearward side of the table surface 6 and projects upwardly therefrom. The function of the fence 9 is to properly align a workpiece 13 to be cut by the saw mechanism 8. The fence 9 also assists the operator in holding a workpiece 13 in proper position while sawing occurs.

The positioner 2 includes a support structure 20, a slide bar 21 mounted on the support structure 20, and a slide 22 mounted on the slide bar 21 and selectively movable, both rotatably and axially, with respect to the slide bar 21. The slide 22 may also be selectively locked into position relative to the slide bar 21, as will be discussed below.

The support structure 20 includes an elongate base 26 and is selectively secured to the saw table 5 by attachment means. In particular, the base 26 is relatively thin and is constructed from a suitable metal strip or the like. The base 26 includes a pair of fastener openings 27, each having a wide or enlarged end 29 for receiving a fastener 28 and a narrower, elongate slot 30 within which an associated fastener 28 can be tightened against the base 20. Each of the fasteners 28 is received in a respective aperture 31 in the table 5, as shown in FIG. 4.

The positioner 2 is constructed to be easily moved from one side of the saw mechanism 8 to the opposite side. This is shown in FIG. 1, wherein the positioner 2 is shown in the first location on the right hand side of the saw mechanism 8 and in a second location, in phantom, on the left hand side of the saw mechanism 8. Preferably, there are screw fasteners, such as 28 or apertures for such fasteners, prepositioned at the proper location on both sides of the saw mechanism 8 and the positioner 2 is relocated simply by loosening the fasteners 28 on one side presently holding the positioner 2, sliding the positioner 2 such that the heads of the fasteners 28 are aligned with the fastener opener enlarged sections 29, and then the positioner 2 is raised upwardly so that the heads of the fasteners 28 pass through the enlarged portions of the openings 29. To replace the positioner 2 in the same location or to move the positioner 2 to a new location, the process is simply reversed. The positioner 2 is easily retrofitted to an existing saw 1 by addition of fasteners 28 to the saw table 5.

The base 26 includes a first upright projecting end 32 and a second upright projecting end 33. The ends 32 and 33 are aligned at approximately 90° to the remainder of the base 26 and are preferably integral therewith. Preferably, the ends 32 and 33 extend approximately two inches upward from the remainder of the base 26 and from the surface 6 of the radial arm saw 1. Near the top of each of the ends 32 and 33 is an opening 35 suitably sized for receiving the slide bar 21.

The slide bar 21 comprises an elongate and round structure 40 extending between and through the openings 35 in each of the ends 32 and 33 so as to be spaced from the base 26. Bar threaded portions at 41 and 42 are positioned on the bar 21 at opposite ends 43 and 44 respectively thereof. The bar threaded portions 41 and 42 extend through the upright end openings 35. Nuts or the like 45 and 46 are positioned on the threaded portions 41 and 42 interior of the ends 32 and 33 respectively. A second set of external nuts of the like 46 and 48 are positioned external of the ends 32 and 33 on the threaded portions 41 and 42 respectively. The nuts 45 and 46 are tightened against the end 32 and the nuts 47 and 48 are tightened against the end 33 in such a manner as to prevent the bar 21 from rotating relative to the base 26. It is foreseen the other suitable means can be utilized to prevent the bar 21 from rotating or translating relative to the support structure 20.

The slide 22 comprises an annular sleeve 49 which is selectively slidable and rotatable with respect to the slide bar 21, a board positioner, placement, or stop member 50 and a bridge 51 interconnecting the sleeve 49 with the stop member 50.

The sleeve 49 includes locking means such as a wing bolt 52 which is threadably mounted in opening 53 passing axially through the sleeve 49. The wing bolt 52 may be selectively positioned against the slide bar 21 in such a manner as to produce sufficient friction to prevent the sleeve 49 from either rotating relative to the slide bar 21 or moving axially therealong. In this way, the wing bolt 52 is utilized by an operator to lock the slide 22 in a desired position both axially and angularly with respect to the slide bar 21. It is foreseen that other types of quick locking devices could be utilized in place of the wing bolt 52.

The stop member 50 is generally rectangular in shape and includes a first generally flat workpiece engaging surface 57 which, as seen in FIG. 1, engages a workpiece 13. An opposite and also generally flat surface 58 is positioned on the stop member 52. The purpose of the surface 58 is to engage a workpiece when the positioner 2 is in the location shown by phantom lines in FIG. 1. The stop member 50 also has a generally flat lower surface 59 which engages the table surface 6 when the slide 22 is operably in position to help an operator measure a specific workpiece 13, as is shown in FIGS. 1 and 4.

The bridge 51 interconnects the stop member 50 with the sleeve 49 such that the stop member 50 fixedly rotates with and slides along the slide bar 21 with the sleeve 49. The bridge 51, in conjunction with the sleeve 49 and stop member 50, define an open channel which is located beneath the bridge 51 and between the sleeve 49 and stop member 50. The channel 61 is designed such that the slide 22 fully clears the radial arm saw fence 9 when the slide 22 is positioned to help an operator measure a workpiece 13, such as is shown in FIGS. 1 through 4, and specifically when the stop member lower surface 59 is positioned against the table surface 6. The clearance that is provided by the bridge 51 is seen in FIG. 4. In particular, the bridge 51 has a lower surface 62 which is spaced above or clears the saw fence 9 at all times during operational use of the positioner 2 and the stop member 50 has a side surface 63 which is also spaced from, or at least clears, the fence 9 at all times during operational use of the positioner 2. In this manner, the slide 22 can be located in an operational position to measure a board to be cut in an infinite number of positions relative to and along the slide bar 21 and the fence 9. The slide, when in operational position to measure a board (that is, with surface 59 against saw surface 6) but with wing bolt 52 loosened, may be slid axially along the slide bar 21 and along the fence 9 without interference from the fence 9.

In use, the positioner 2 is mounted on a radial arm saw 1, as shown in FIG. 1. The positioner 2 is preferably mounted on previously located fasteners such as 28 in the manner previously described. An operator unscrews the wing bolt 52 sufficiently to allow the slide 22 to rotate and move axially easily with respect to the slide bar 21. The slide 22 is moved axially along the slide bar 21 to a position such that the first surface 57 of the slide 22 will be at a desired distance from the blade of the saw mechanism 8. The distance is the length which is desired for a board to be cut from the workpiece 13. The slide 22 is rotated relative to the slide bar 21 such that the slide bottom surface 59 rests on the table surface 6, as seen in FIG. 4 and, thereafter, the wing bolt 52 is tightened. The board is then cut. After the board is cut, the operator may leave the slide 22 in its then current position, if it is desired to cut additional boards of the same length. However, if a new board length is desired or if it is desirable to remove the slide 22 completely from the pathway of a board, then the wing bolt 52 is again loosened and the stop member is rotated upwardly and rearwardly such that the sleeve 49 rotates about the slide bar 21 to provide a clear path for a board positioned against the saw fence 9 and on the surface 6. Alternatively, if a new board length is desired to be determined by the slide 22, the slide 22 is moved to the new position and again locked in place by operation of the wing bolt 52. If the operator desires to cut boards from the opposite side of the saw or move the positioner to a nearby table for extending the length of board to be cut, then the positioner 2 is removed from the table 5, as has been described before, and moved to the new location.

It is to be understood that while certain forms of the present invention have been illustrated and described herein, it is not to be limited to the specific forms or arrangement of parts described and shown.

What is claimed and desired to be secured by Letters Patent is as follows:

1. A positioner adapted for retrofitting to a power saw wherein a cutting blade is movable relative to a table top; the saw having a fence attached to the table top for positioning a workpiece; said positioner comprising:

(a) a support structure adapted to be removably attached to the table top behind the fence; said support structure comprising a unitary elongate member base strip having upstanding struts at either end thereof, a pair of fastener openings and a pair of elongated slots each communicating with a respective fastener opening;

(b) a slide bar non-rotatably mounted near opposite ends thereof to said support structure struts and adapted to be positioned along and spaced from the fence;

(c) a slide mounted on said slide bar and being axially positionable at an infinite number of positions therealong; said slide selectively being rotatably positionable relative to said slide bar;

(d) said slide including a workpiece stop member extending laterally from said slide and adapted to engage a workpiece on the saw;

(e) locking means to selectively lock said slide axially with respect to said slide bar;

(f) said stop including a bridge member allowing said stop to arc over the fence at any location along said slide bar such that said stop member is positionable against a work surface of the saw in front of the fence and is infinitely adjustable along the fence and such that said slide is rotatable away from the work surface to a location above said slide bar such that said positioner is free of interference with a workpiece on the work surface and further said bridge allows said slide to be adapted to work cooperatively with the fence of the saw so that the slide does not interfere with the fence during use and the fence does not have to be modified to use said positioner; and (g) fastening means for removably attaching said support structure to said table top such that said positioner may be retrofitted on said table top and may be selectively removed when not in use, said fastening means comprising a pair of screws with heads having diameters less than the widths of said fastener openings and greater than the width of said slots.

2. The positioner in accordance with claim 1 wherein:

(a) said bar includes selective locking means allowing an operator to selectively lock said bar in a predetermined position both axially and angularly relative to said slide bar.

3. A motorized saw wherein a cutting blade is movable relative to a work table in combination with a positioner; said saw including said work table having a table top and a work surface, a fence attached to the table top adapted to position a workpiece to be cut there against and a saw mechanism adapted to cut a workpiece; said positioner comprising:

(a) a support structure attachable to said table top behind the fence; said support structure comprising a unitary elongate member base strip having upstanding struts at either end thereof, a pair of fastener openings and a pair of elongated slots each communicating with a respective fastener opening;

(b) a slide bar non-rotatably mounted near opposite ends thereof to said support structure struts and operably positioned along and spaced from said fence;

(c) a slide mounted on said slide bar and being axially positionable at an infinite number of positions therealong; said slide selectively being rotatably positionable relative to said slide bar;

(d) said slide including a workpiece stop member extending laterally from said slide and being adapted to engage a workpiece positioned on said saw work surface;

(e) locking means to lock said slide both axially and rotatably with respect to said slide bar;

(f) said stop member including a bridge member allowing said stop member to arc over said fence at any location along said slide bar such that said stop member is positionable against said saw work surface in front of said fence and is infinitely adjustable along said fence and such that said slide is rotatable away from the work surface to a location above said slide bar such that said positioner is free of interference with a workpiece on said work surface and further said bridge allows said slide to work cooperatively with the fence of the saw so that the slide and stop member does not interfere with the fence during use and the fence does not have to be modified to use said positioner; and (g) fastening means removably attaching said support structure to said table top such that said positioner may be retrofitted on said table top and may be selectively removed when not in use, said fastening means comprising a pair of screws positioned within said table top with heads having diameters less than the widths of said fastener openings and greater than the width of said slots whereby said positioner is securable to said table top when said screws are placed within said slots and tightened.

4. The combination in accordance with claim 3 wherein:

(a) said bar includes selective locking means allowing an operator to selectively lock said bar in a predetermined position both axially and angularly relative to said slide bar.

* * * * *